US011538375B2

(12) United States Patent
Sun et al.

(10) Patent No.: US 11,538,375 B2
(45) Date of Patent: Dec. 27, 2022

(54) PIXEL CIRCUIT AND TESTING METHOD

(71) Applicants: Chongqing BOE Display Technology Co., Ltd., Chongqing (CN); BOE Technology Group Co., Ltd., Beijing (CN)

(72) Inventors: Shicheng Sun, Beijing (CN); Jonguk Kwak, Beijing (CN); Dawei Shi, Beijing (CN); Wei Zhang, Beijing (CN); Cunzhi Li, Beijing (CN); Pei Wang, Beijing (CN)

(73) Assignees: CHONGQING BOE DISPLAY TECHNOLOGY CO., LTD., Chongqing (CN); BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 0 days.

(21) Appl. No.: 17/417,440

(22) PCT Filed: Nov. 26, 2020

(86) PCT No.: PCT/CN2020/131773
§ 371 (c)(1),
(2) Date: Jun. 23, 2021

(87) PCT Pub. No.: WO2021/104372
PCT Pub. Date: Jun. 3, 2021

(65) Prior Publication Data

US 2022/0076601 A1 Mar. 10, 2022

(30) Foreign Application Priority Data

Nov. 28, 2019 (CN) ..... 201911190017.7

(51) Int. Cl.
*G09G 3/3266* (2016.01)
*G09G 3/3275* (2016.01)
*G09G 3/00* (2006.01)

(52) U.S. Cl.
CPC ..... *G09G 3/006* (2013.01); *G09G 3/3266* (2013.01); *G09G 3/3275* (2013.01); *G09G 2300/0842* (2013.01); *G09G 2310/061* (2013.01)

(58) Field of Classification Search
CPC ..... G06F 11/22
See application file for complete search history.

(56) References Cited

U.S. PATENT DOCUMENTS 7,417,215 B2 8/2008 Choi
10,004,124 B1 * 6/2018 Ko ..... H05B 33/10
(Continued)

FOREIGN PATENT DOCUMENTS

CN 1942029 A 4/2007
CN 102819996 A 12/2012
(Continued)

OTHER PUBLICATIONS

CN201911190017.7 First Office Action.
CN201911190017.7 search report.

*Primary Examiner* — Nitin Patel
*Assistant Examiner* — Amen W Bogale
(74) *Attorney, Agent, or Firm* — IPRO, PLLC

(57) ABSTRACT

The disclosure relates to a pixel circuit and a testing method of the pixel circuit. The pixel circuit comprises a light emitting element, a storage capacitor Cst, a drive sub-circuit, a reset sub-circuit, a write sub-circuit, a light emission control sub-circuit and a testing element, wherein a control terminal of the testing element is connected to s reset control signal line, a first terminal of the testing element is connected to a reset signal line, a second terminal of the testing
(Continued)

element is connected to the drive sub-circuit, and the testing element is configured to test elements included in the pixel circuit.

17 Claims, 4 Drawing Sheets

(56) References Cited

U.S. PATENT DOCUMENTS

| | | | | |
|---|---|---|---|---|
| 11,145,241 | B2 * | 10/2021 | Chen | G09G 3/3233 |
| 2012/0313923 | A1 | 12/2012 | Minami et al. | |
| 2014/0092144 | A1 * | 4/2014 | Kim | G09G 3/3233 345/76 |
| 2015/0339979 | A1 | 11/2015 | Kikuchi et al. | |
| 2016/0155409 | A1 | 6/2016 | Jeoung et al. | |
| 2017/0278457 | A1 * | 9/2017 | Zhu | G09G 3/3233 |
| 2017/0309231 | A1 | 10/2017 | Li et al. | |
| 2018/0350301 | A1 | 12/2018 | Takizawa et al. | |
| 2019/0130833 | A1 * | 5/2019 | Gao | G09G 3/3291 |
| 2019/0156718 | A1 | 5/2019 | Moradi et al. | |
| 2020/0043417 | A1 * | 2/2020 | Yang | G09G 3/3291 |
| 2020/0135094 | A1 | 4/2020 | Chen et al. | |
| 2021/0012692 | A1 | 1/2021 | Wang et al. | |
| 2021/0020084 | A1 | 1/2021 | Fan et al. | |
| 2021/0118371 | A1 | 4/2021 | Qing et al. | |
| 2021/0174743 | A1 * | 6/2021 | Chang | G09G 3/3258 |
| 2021/0225275 | A1 * | 7/2021 | Cho | G09G 3/3233 |
| 2022/0108655 | A1 * | 4/2022 | Yu | G09G 3/3233 |

FOREIGN PATENT DOCUMENTS

| | | | |
|---|---|---|---|
| CN | 104882100 | A | 9/2015 |
| CN | 105448215 | A | 3/2016 |
| CN | 105654882 | A | 6/2016 |
| CN | 105702186 | A | 6/2016 |
| CN | 106165007 | A | 11/2016 |
| CN | 106991964 | A | 7/2017 |
| CN | 107507572 | A | 12/2017 |
| CN | 107731143 | A | 2/2018 |
| CN | 108182897 | A | 6/2018 |
| CN | 108877685 | A | 11/2018 |
| CN | 109523946 | A | 3/2019 |
| CN | 109742037 | A | 5/2019 |
| CN | 110010066 | A | 7/2019 |
| CN | 110264931 | A | 9/2019 |
| CN | 110827730 | A | 2/2020 |

* cited by examiner

400

PIXEL CIRCUIT AND TESTING METHOD

CROSS REFERENCE TO RELEVANT DISCLOSURES

The application claims priority to Chinese Patent Application No. 201911190017.7, filed on Nov. 28, 2019, the contents of which are incorporated herein by reference in its entirety.

TECHNICAL FIELD

The present disclosure relates to the technical field of display, in particular to a pixel circuit and a testing method.

BACKGROUND

A driving part of an LTPS AMOLED display panel is composed of a plurality of thin film transistors (TFT), and the performance of these TFTs directly affects the display effect of the display panel. Therefore, performance testing of TFTs is very important in the production of display panels.

SUMMARY

The present disclosure discloses a pixel circuit and testing method.

The present disclosure provides a pixel circuit, comprising:

a light emitting element;

a drive sub-circuit configured to generate a current for causing the light emitting element to emit light;

a reset sub-circuit configured to receive a reset control signal from a reset control signal line and a reset signal from a reset signal line, and reset the drive sub-circuit and an anode of the light emitting element with the reset signal under the action of the reset control signal;

a write sub-circuit configured to receive a data signal from a data line and a scan signal from a scan signal line, and to supply the data signal to the drive sub-circuit under the action of the scan signal;

a light emission control sub-circuit configured to receive a first supply voltage from a first power line and a light emission control signal from a light emission signal line, and to supply the first supply voltage to the drive sub-circuit and the current generated by the drive sub-circuit to the anode of the light emitting element under the action of the light emission control signal; and a testing element, a control terminal of the testing element being connected to the reset control signal line, a first terminal of the testing element being connected to the reset signal line, a second terminal of the testing element being connected to the drive sub-circuit, and the testing element being configured to test elements included in the pixel circuit.

Optionally, a plurality of testing terminals including testing control terminals and testing output terminals and configured in such a way that testing control signals are applied via the testing control terminals and testing output signals are acquired via the testing output terminals, so that the elements included in the pixel circuit are tested according to the testing output signals.

Optionally, the testing control terminals include a first testing control terminal connected to the reset signal line, a second testing control terminal connected to the reset control signal line, a third testing control terminal connected to the light emission control signal line and a fourth testing control terminal connected to the scanning signal line; and the testing output terminals include a first testing output terminal connected to the first power line and a second testing output terminal connected to the anode of the light emitting element.

Optionally, wherein the plurality of testing terminals are disposed in the same layer as the anode of the light emitting element.

Optionally, the first testing control terminal to the fourth testing control terminal and the first testing output terminal and the second testing output terminal are all formed on an uppermost OLED anode layer of a substrate.

Optionally, the first testing control terminals of a plurality of pixel circuits are connected by metal wires arranged on the uppermost OLED anode layer of the substrate.

Optionally, the drive sub-circuit comprises a driving transistor and a storage capacitor, a first pole of the storage capacitor is connected to the first power line, a second pole of the storage capacitor is connected to a grid of the driving transistor and a second terminal of the testing element, and a first pole and a second pole of the driving transistor are both connected to the light emission control sub-circuit.

Optionally, wherein the reset sub-circuit comprises a first transistor and a seventh transistor, a grid of the first transistor is connected to the reset control signal, a first pole of the first transistor is connected to the second terminal of the testing element, a second pole of the first transistor is connected to the reset signal line, a grid of the seventh transistor is connected to the scan signal line, a first pole of the seventh transistor is connected to the anode of the light emitting element, and a second pole of the seventh transistor is connected to the reset signal line.

Optionally, wherein the write sub-circuit comprises a second transistor and a fourth transistor, a grid of the second transistor and a grid of the fourth transistor are both connected to the scan signal line, a first pole of the second transistor is connected to the second pole of the driving transistor, a second pole of the second transistor is connected to the grid of the driving transistor; and a first pole of the fourth transistor is connected to the data signal line, and a second pole of the fourth transistor is connected to the first pole of the driving transistor.

Optionally, wherein the light emission control sub-circuit comprises a fifth transistor and a sixth transistor, a grid of the fifth transistor and a grid of the sixth transistor are both connected to the light emission control signal line, a first pole of the fifth transistor is connected to the first power line, a second pole of the fifth transistor is connected to the first pole of the driving transistor, a first pole of the sixth transistor is connected to the second pole of the driving transistor; and a second pole of the sixth transistor is connected to the anode of the light emitting element, and a cathode of the light emitting element is connected to a second power line.

Optionally, wherein the testing element comprises an eighth transistor, a grid of the eighth transistor serves as the control terminal of the testing element, and first and second poles of the eighth transistor serve as the first and second terminals of the testing element respectively.

The disclosure provides a testing method of the pixel circuit, comprising:

cutting off the wiring at a designated position in the pixel circuit to obtain a testing circuit including at least one designated element of the pixel circuit; and testing the at least one designated element by the testing circuit.

Optionally, wherein testing the at least one designated element by the testing circuit comprises:

determining at least one testing control terminal and testing output terminal from the testing control terminals and the testing output terminals according to a designated element to be tested among the at least one designated element;

applying a testing control signal to the testing circuit via the determined at least one testing control terminal; and acquiring a testing output signal via the determined testing output terminal, and testing the designated element to be tested according to the testing output signal.

Optionally, wherein the testing circuit comprises a driving transistor, a fifth transistor, a sixth transistor and an eighth transistor, and testing the at least one designated element by the testing circuit comprises:

when testing the driving transistor, the first testing control terminal serves as the grid of the driving transistor, the first testing output terminal serves as the source of the driving transistor, and the second testing output terminal serves as the drain of the driving transistor;

when testing the fifth transistor, the third testing control terminal serves as the grid of the fifth transistor, the first testing output terminal serves as the first pole of the fifth transistor, and the second testing output terminal serves as the second pole of the fifth transistor; and when testing the sixth transistor, the third testing control terminal serves as the grid of the sixth transistor, the first testing output terminal serves as the first pole of the sixth transistor, and the second testing output terminal serves as the second pole of the sixth transistor.

Optionally, wherein the testing circuit comprises a first transistor, an eighth transistor, and a seventh transistor in the adjacent pixel row, and testing the at least one designated element by the testing circuit comprises:

when testing the first transistor or the eighth transistor, the second testing control terminal serves as the grids of the first transistor and the eighth transistor, the first testing control terminal serves as the first poles of the first transistor and the eighth transistor, and the second testing output terminal of the adjacent pixel row serves as the second poles of the first transistor and the eighth transistor; and when testing the seventh transistor in the adjacent pixel row, the fourth testing control terminal serves as the grid of the seventh transistor, the first testing control terminal serves as the first pole of the seventh transistor, and the second testing output terminal of the adjacent pixel row serves as the second pole of the seventh transistor.

Optionally, wherein the testing circuit comprises a second transistor, a sixth transistor and an eighth transistor, and testing the at least one designated element by the testing circuit comprises:

when testing the second transistor, the fourth testing control terminal serves as the grid of the second transistor, the second testing output terminal serves as the first pole of the second transistor, and the first testing control terminal serves as the second pole of the second transistor;

when testing the sixth transistor, the third testing control terminal serves as the grid of the sixth transistor, the first testing control terminal serves as the first pole of the sixth transistor, and the second testing output terminal serves as the second pole of the sixth transistor; and when testing the eighth transistor, the second testing control terminal serves as the grid of the eighth transistor, the first testing control terminal serves as the first pole of the eighth transistor, and the second testing output terminal serves as the second pole of the eighth transistor.

Optionally, wherein the testing circuit comprises fourth transistors respectively located in an adjacent first pixel row and second pixel row and fifth transistors respectively located in the first pixel row and the second pixel row, and testing the at least one designated element by the testing circuit comprises:

when testing the fourth transistor in the first pixel row, the fourth testing control terminal in the first pixel row serves as the grid of the fourth transistor, the first testing output terminal in the second pixel row serves as the first pole of the fourth transistor, and the first testing output terminal in the first pixel row serves as the second pole of the fourth transistor; and when testing the fifth transistor in the first pixel row, the third testing control terminal in the first pixel row serves as the grid of the fifth transistor, the first testing output terminal in the first pixel row serves as the first pole of the fifth transistor, and the first testing output terminal in the second pixel row serves as the second pole of the fifth transistor.

The above description is only an overview of the technical solution of this disclosure, which can be implemented according to the contents of the specification in order to understand the technical means of this disclosure more clearly, and in order to make the above and other objects, features and advantages of this disclosure more obvious and understandable, the detailed description of this disclosure will be given below.

BRIEF DESCRIPTION OF THE DRAWINGS

In order to explain the technical solution in the embodiments of the disclosure or related arts more clearly, the drawings used in the description of the embodiments or related arts will be briefly introduced below. Obviously, the drawings in the following description are only some embodiments of the disclosure, and for those of ordinary skill in the art, other drawings can be obtained according to these drawings without creativity.

DETAILED DESCRIPTION

In order to make those skilled in the art better understand the embodiments of this disclosure, the embodiments of this disclosure will be further described in detail with reference to the drawings and implementation methods. It should be noted that the embodiments in this application and the features in the embodiments can be freely combined with each other without conflict.

Figure 1:
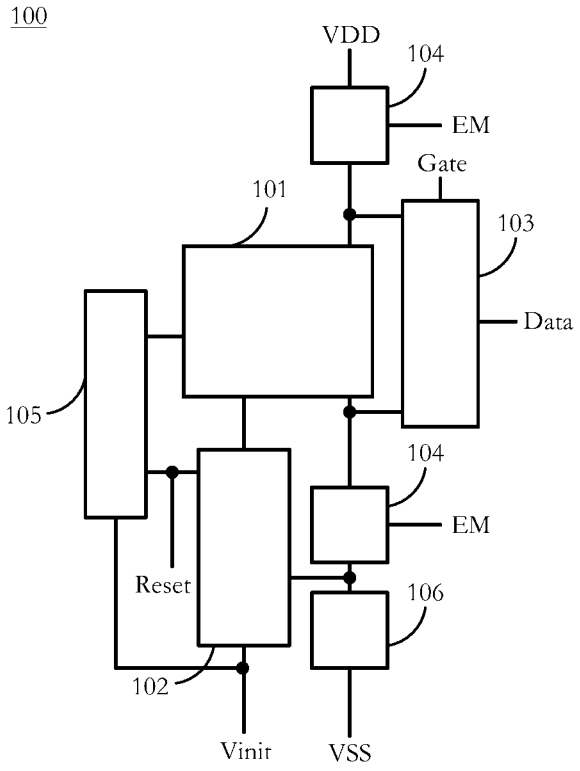
FIG. 1 is a structural diagram of a pixel circuit according to an embodiment of the disclosure.

FIG. 1 is a structural diagram of a pixel circuit according to an embodiment of the disclosure. As shown in FIG. 1, the pixel circuit 100 in the embodiment of the disclosure is used to test the TFT characteristics in a pixel area of an LTPS AMOLED display panel. As shown in FIG. 1, the pixel circuit 100 comprises a drive sub-circuit 101, a reset sub-circuit 102, a write sub-circuit 103, a light emission control sub-circuit 104, a testing element 105 and a light emitting element 106.

According to the embodiment, the drive sub-circuit 101 is configured to generate a current for causing the light emitting element 106 to emit light. The reset sub-circuit 102 is configured to receive a reset control signal (Reset) from a reset control signal line and a reset signal (Vinit) from a reset signal line, and reset the drive sub-circuit 101 and an anode of the light emitting element 106 with the reset signal under the action of the reset control signal, so that data signals in the subsequent stages can be stored more quickly and reliably; meanwhile, the light emitting element can be displayed in a black state before emitting light, and the display effect such as contrast of a displaying device using the pixel circuit can be improved. The write sub-circuit 103 is configured to receive a data signal (Data) from a data line and a scan signal (Gate) from a scan signal line, and to supply the data signal to the drive sub-circuit 101 under the action of the scan signal. The light emission control sub-circuit 104 is configured to receive a first supply voltage (VDD) from a first power line and a light emission control signal (EM) from a light emission signal line, and to supply the first supply voltage to the drive sub-circuit 101 and the current generated by the drive sub-circuit 101 to the anode of the light emitting element 106 under the action of the light emission control signal. A control terminal of the testing element 105 is connected to the reset control signal line, a first terminal of the testing element 105 is connected to the reset signal line, a second terminal of the testing element is connected to the drive sub-circuit 101, and the testing element is configured to test elements included in the pixel circuit 100. The anode and cathode of the light emitting element 106 are connected to the first supply voltage VDD (for example, a high-level voltage) and a second supply voltage VSS (for example, a low-level voltage) respectively, so that the light emitting element emits light under the action of the driving current generated by the drive sub-circuit 101.

According to the embodiment, a plurality of testing terminals are also provided in the same layer as the anode of the light emitting element 106. The plurality of testing terminals include testing control terminals and testing output terminals. According to the embodiment, testing control signals can be applied via the testing control terminals and testing output signals can be acquired via the testing output terminals, so that the elements included in the pixel circuit can be tested according to the testing output signals.

Figure 2:
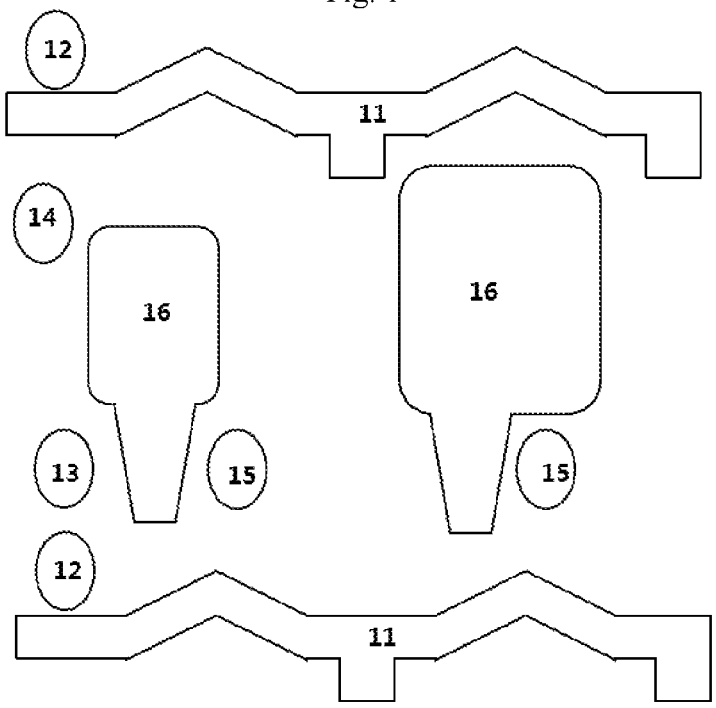
FIG. 2 is a layout diagram of a testing terminal according to an embodiment of the disclosure.

FIG. 2 is a layout diagram of a testing terminal according to an embodiment of the disclosure. As shown in FIG. 2, the testing control terminals include a first testing control terminal 11 configured to be connected to a reset signal (Vinit) line and a first terminal of a testing element; a second testing control terminal 12 configured to be connected to a reset signal (Reset) line, that is, connected to a scan signal ($Gate_{n-1}$) line of a previous-stage pixel circuit; a third testing control terminal 13 configured to be connected to a light emission control signal (EM) line; and a fourth testing control terminal 14 configured to be connected to a scan signal ($Gate_n$) line. The testing output terminals include a first testing output terminal 15 configured to be connected to a first power (VDD) line; and a second testing output terminal 16 configured to be connected to an anode of a light emitting element OLED.

According to the embodiment, the first testing control terminal 11 to the fourth testing control terminal 14 and the first testing output terminal 15 and the second testing output terminal 16 are all formed on an uppermost OLED anode layer of a substrate. More preferably, the first testing control terminals 11 of a plurality of pixel circuits are connected by metal wires arranged on the uppermost OLED anode layer of the substrate. Specifically, a pattern of a metal testing terminal is designed on the anode layer, and connecting points between the testing terminal and via holes are formed by photolithography, etching and other processes to realize the above connection relationship.

The first testing control terminal 11 to the fourth testing control terminal 14 and the first testing control terminal 11, the first testing output terminal 15 and the second testing output terminal 16 can form a "4 control terminals+3 input/output terminals" structure, and the characteristics of multiple transistors in the circuit can be tested through the cooperation of multiple testing terminals.

Figure 3:
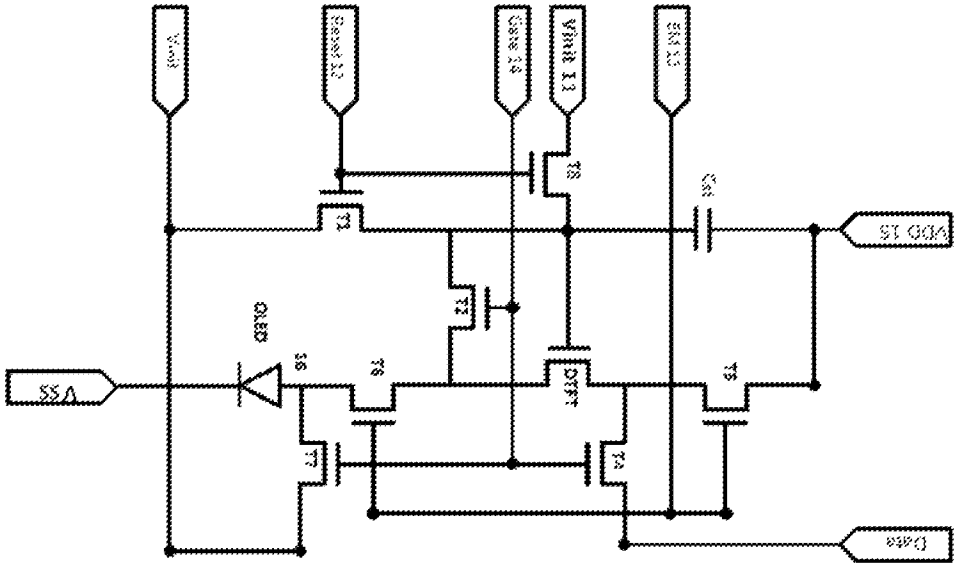
FIG. 3 is a circuit diagram of a pixel circuit according to an embodiment of the disclosure.

FIG. 3 is a circuit diagram of a pixel circuit according to an embodiment of the disclosure. In FIG. 3, a 7T1C pixel driving circuit is illustrated as an example. It can be easily understood that other common pixel driving circuit structures such as 6T1C, 6T2C, 5T1C and 4T1C can be adopted, and FIG. 3 is only an example, and is not used to limit the embodiment of the disclosure.

As shown in FIG. 3, the drive sub-circuit comprises a driving transistor DTFT and a storage capacitor Cst. A first pole of the storage capacitor Cst is connected to the first power (VDD) line, and a second pole of the storage capacitor Cst is connected to a grid of the driving transistor DTFT and a second terminal of the testing element. A first pole and a second pole of the driving transistor DTFT are both connected to the light emission control sub-circuit. The grid of the driving transistor DTFT and the second pole of the storage capacitor Cst can discharge electricity under the control of the reset control signal (Reset).

As shown in FIG. 3, the testing element may comprise an eighth transistor T8, a grid of the eighth transistor T8 serves as the control terminal of the testing element, and first and second poles of the eighth transistor T8 serve as the first and second terminals of the testing element respectively. The eighth transistor T8 can be formed at the same time as other transistors in the pixel circuit, but does not work when other transistors are used, so the eighth transistor T8 will not affect the performance of the circuit.

In addition, the structure of the transistor T8 can optimize the reset function of the storage capacitor Cst, and can be used as a grid control terminal for testing the driving transistor DTFT on the premise that the working state of the circuit is not affected. Especially, the first pole of the transistor T8 is connected to reset voltage Vinit, so as to better discharge the power of the storage capacitor Cst and the driving transistor DTFT.

The first pole of the eighth transistor T8 is connected to the first testing control terminal 11, the second pole is connected to the grid of the driving transistor DTFT, and the grid of the eighth transistor T8 is connected to the second testing control terminal 12.

It should be noted that in 7T1C, 6T1C, 6T2C, 5T1C and 4T1C circuits, any solution where the grid of the driving transistor can discharge electricity through the reset signal line can be realized by the inventive concept of the disclosure, that is, a new transistor T8 is added, the grid of T8 is connected to the reset control signal line, and the second pole of T8 is connected to the grid of the driving transistor.

As shown in FIG. 3, the reset sub-circuit comprises a first transistor T1 and a seventh transistor T7. A grid of the first transistor T1 is connected to the reset control signal (Reset) (i.e., the scan signal $Gate_{n-1}$ of the previous-stage pixel circuit), and a first pole of the first transistor T1 is connected to the second pole of the eighth transistor T8, the grid of the driving transistor DTFT and the first pole of the storage capacitor Cst. A second pole of the first transistor T1 is connected to the reset signal Vinit. A grid of the seventh transistor T7 is connected to the scan signal $Gate_n$, a first pole of T7 is connected to the anode of the light emitting element OLED, and a second pole is connected to the reset signal Vinit.

The write sub-circuit comprises a second transistor T2 and a fourth transistor T4. A grid of the second transistor T2 and a grid of the fourth transistor T4 are both connected to the scan signal $Gate_n$, a first pole of the second transistor T2 is connected to the second pole of the driving transistor DTFT, and a second pole is connected to the grid of the driving transistor DTFT. A first pole of the fourth transistor T4 is connected to the data signal (Data), and a second pole is connected to the first pole of the driving transistor DTFT.

The light emission control sub-circuit comprises a fifth transistor T5 and a sixth transistor T6. A grid of the fifth transistor T5 and a grid of the sixth transistor T6 are both connected to the light emission control signal (EM), a first pole of the fifth transistor T5 is connected to the first power supply VDD, and a second pole is connected to the first pole of the driving transistor DTFT. A first pole of the sixth transistor T6 is connected to the second pole of the driving transistor DTFT, and a second pole is connected to the anode of the light emitting element OLED.

When the pixel circuit is in a normal display state:

In a first period, the scan signal $Gate_{n-1}$ of the previous-stage pixel circuit (i.e., the reset control signal of the current pixel circuit) and the scan signal $Gate_n$ of this stage turn on the first transistor T1 and the seventh transistor T7, so that the storage capacitor Cst and the anode of the light emitting element OLED communicate with the reset signal line, and electricity is discharged.

In a second period, the scan signal $Gate_n$ turns on the fourth transistor T4 and the second transistor T2, and data voltage is written into the storage capacitor Cst through the fourth transistor T4, the driving transistor DTFT and the second transistor T2.

In a third period, the light emission control signal (EM) turns on the fifth transistor T5 and the sixth transistor T6, and the power supply VDD is applied to the anode of the light emitting element OLED through the fifth transistor, the driving transistor DTFT and the sixth transistor T6, thereby causing the light emitting element OLED to emit light.

Figure 4:
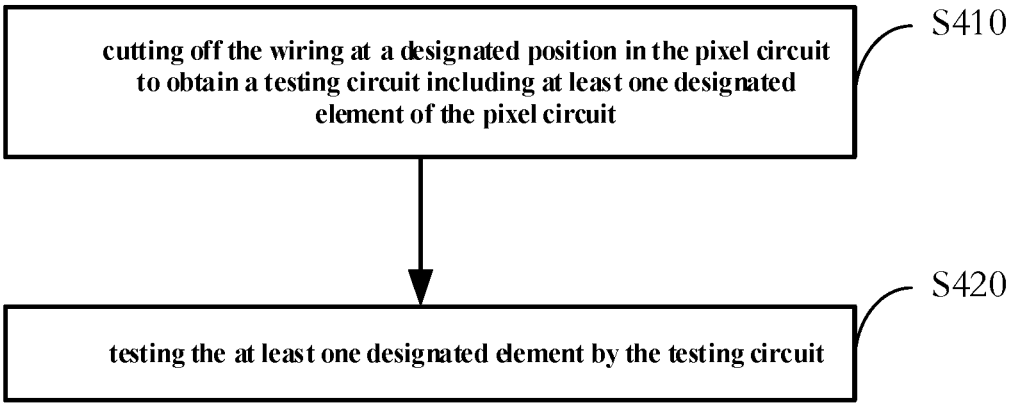
FIG. 4 is a flowchart of a testing method according to an embodiment of the disclosure.

When the characteristics of the transistors need to be tested, part of the circuit is cut off as needed, some transistors are disconnected from the circuit, and the remaining part of the circuit is used for testing. FIG. 4 is a flowchart of a testing method 400 according to an embodiment of the disclosure. As shown in FIG. 4, the testing method 400 comprises the following Steps:

Step S410, cutting off the wiring at a designated position in the pixel circuit to obtain a testing circuit including at least one designated element of the pixel circuit; and Step S420, testing the at least one designated element by the testing circuit.

According to the embodiment, testing the at least one designated element by using the testing circuit comprises: determining at least one testing control terminal and testing output terminal from the testing control terminals and the testing output terminals according to a designated element to be tested among the at least one designated element, applying a testing control signal to the testing circuit via the determined at least one testing control terminal, acquiring a testing output signal via the determined testing output terminal, and testing the designated element to be tested according to the testing output signal. FIGS. 5 to 8 show structural diagrams of the testing circuit according to the embodiment of the disclosure. Next, the process of testing at least one designated element by using the testing circuit will be described in detail with reference to FIGS. 5 to 8.

1. Testing the Driving Transistor DTFT, the Fifth Transistor T5 and the Sixth Transistor T6

Figure 5:
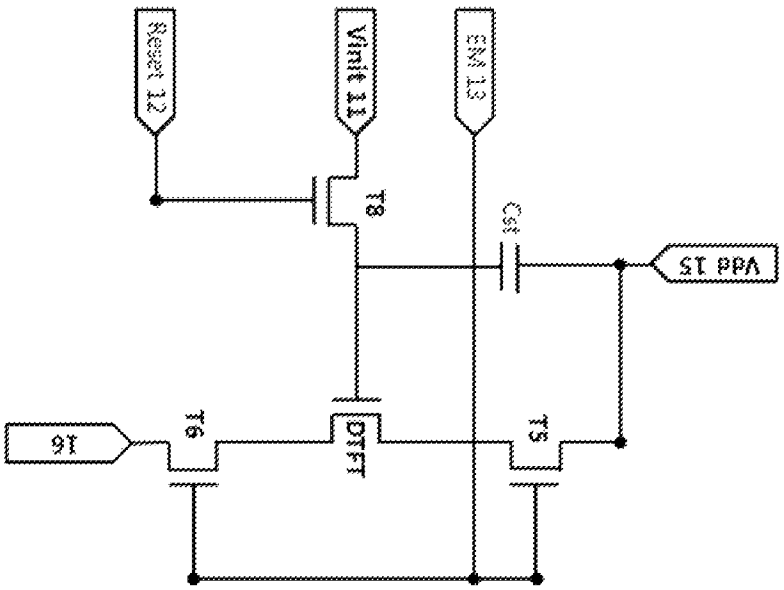
FIG. 5 is a first structural diagram of a testing circuit according to an embodiment of the disclosure.

When the driving transistor DTFT, the fifth transistor T5 or the sixth transistor T6 needs to be tested, part of the circuit is cut off to disconnect the first transistor T1, the second transistor T2, the fourth transistor T4 and the seventh transistor T7 from the circuit to form a circuit structure of a testing circuit as shown in FIG. 5, which includes the driving transistor DTFT, the fifth transistor T5, the sixth transistor T6 and the eighth transistor T8.

To test the driving transistor DTFT, a low-level signal is applied to the third testing control terminal 13 connected to the light emission control signal (EM) line and the second testing control terminal 12 connected to the reset control signal (Reset) line, thereby turning on the eighth transistor T8, the fifth transistor T5 and the sixth transistor T6. As shown in FIG. 5, the first testing control terminal 11 serves as the grid of the driving transistor DTFT via the eighth transistor T8, the first testing output terminal 15 serves as the source of the driving transistor DTFT via the fifth transistor T5, and the second testing output terminal 16 serves as the drain of the driving transistor DTFT via the sixth transistor T6. The performance of DTFT can be tested by lapping a probe on the corresponding testing terminal. Conventional TFT characteristic evaluation includes, but is not limited to, the transfer characteristic curve Id~Vg and the output characteristic curve Id~Vd of TFT, as well as TFT characteristic parameters (such as threshold voltage, mobility and off-state leakage current).

To test the fifth transistor T5 or the sixth transistor T6, the first testing control terminal 11 and the second testing control terminal 12 keep a low potential to turn on the eighth transistor T8 and the driving transistor DTFT. The third testing control terminal 13 can serve as the grid of the fifth transistor T5/ sixth transistor T6, the first testing output terminal 15 (or via the fifth transistor T5) as the first pole, e.g., source, of the fifth transistor T5 (or the sixth transistor T6), and the second testing output terminal 16 (or via the sixth transistor T6) as the second pole, e.g., drain, of the sixth transistor T6 (or the fifth transistor T5), thereby forming a T5/T6 characteristic testing circuit.

2. Testing the First Transistor T1, the Seventh Transistor T7 and the Eighth Transistor T8

Figure 6:
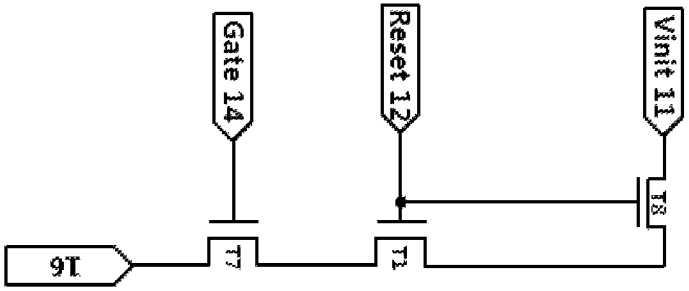
FIG. 6 is a second structural diagram of a testing circuit according to an embodiment of the disclosure.

When the first transistor T1, the seventh transistor T7 or the eighth transistor T8 needs to be tested, part of the circuit is cut off to disconnect the second transistor T2 to the sixth transistor T6 and the storage capacitor Cst from the circuit, and the electrical connection between the second poles of the first transistor T1 and the seventh transistor T7 and the reset signal line is cut off to form a circuit structure of a testing circuit as shown in FIG. 6, which includes the first transistor T1, the seventh transistor T7 and the eighth transistor T8.

It should be noted that in this testing circuit, the first transistor T1 and the eighth transistor T8 are located in the same pixel row, while due to the manufacturing process, the seventh transistor T7 is located in the previous pixel row adjacent to the pixel row where the first transistor T1 and the eighth transistor T8 are located; that is, adjacent to the first transistor T1 (*n*) and the eighth transistor T8 (*n*) in the current pixel row (n<th> row) is the seventh transistor T7 (*n*−1) in the previous pixel row ((n−1)<th> row), while the seventh transistor T7 (*n*) in the current pixel row (n<th> row) is located near the first transistor T1 (*n*+1) and the eighth transistor T8 (*n*+1) in the next pixel row ((n+1)<th> row).

During testing, the second testing control terminal 12 serves as the grids of the first transistor T1 and the eighth transistor T8, the first testing control terminal 11 serves as the first poles of the first transistor T1 and the eighth transistor T8, and the second testing output terminal 16 of the adjacent pixel row ((n−1)<th> row) serves as the second pole. The performance of the first transistor T1 or the eighth transistor can be tested by lapping a probe on the corresponding testing terminal.

The fourth testing control terminal 14 serves as the grid of the seventh transistor T7, the first testing control terminal 11 serves as the first pole of the seventh transistor T7, and the second testing output terminal 16 of the adjacent pixel row ((n−1)<th> row) serves as the second pole. The performance of the seventh transistor T7 can be tested by lapping a probe on the corresponding testing terminal.

3. Testing the Second Transistor T2, the Sixth Transistor T6 and the Eighth Transistor T8

Figure 7:
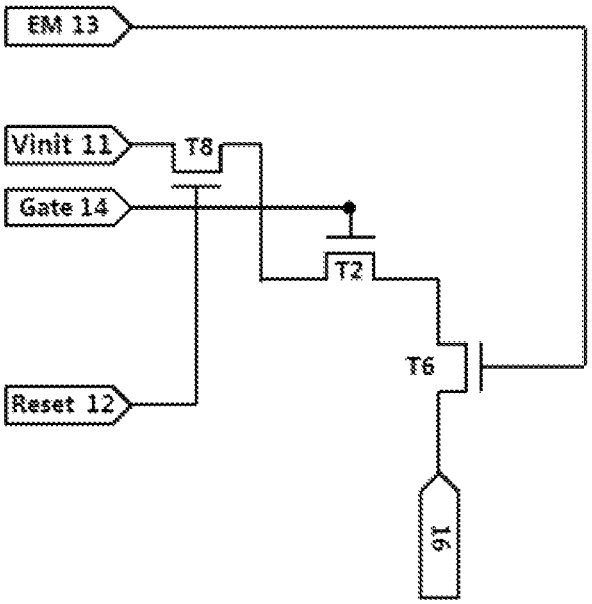
FIG. 7 is a third structural diagram of a testing circuit according to an embodiment of the disclosure.

When the second transistor T2, the sixth transistor T6 or the eighth transistor T8 needs to be tested, part of the circuit is cut off to disconnect the first transistor T1, the driving transistor DTFT, the fourth transistor T4, the fifth transistor T5, the seventh transistor T7 and the storage capacitor Cst from the circuit, and the electrical connection between the second poles of the first transistor T1 and the seventh transistor T7 and the reset signal line is cut off, thus forming a circuit structure of a testing circuit as shown in FIG. 7, which includes the second transistor T2, the sixth transistor T6 and the eighth transistor T8.

To test T2, a low-level signal is applied to the third testing control terminal 13 connected to the light emission control signal (EM) line and the second testing control terminal 12 connected to the reset signal line (Reset) to turn on the eighth transistor T8 and the sixth transistor T6. The first testing control terminal 11 can serve as the first pole of the second transistor T2 via the eighth transistor T8, the second testing output terminal 16 can serve as the second pole of the second transistor T2 via the sixth transistor T6, and the fourth testing control terminal 14 serves as the grid of the the second transistor T2.

With this circuit, the sixth transistor T6 can be tested in the same way. The fourth testing control terminal 14 connected to the scan signal line and the second testing control terminal 12 connected to the reset signal line (Reset) keep a low potential to turn on the eighth transistor T8 and the second transistor T2. The first testing control terminal 11 can serve as the first pole of the sixth transistor T6 via the eighth transistor T8 and the second transistor T2, the second testing output terminal 16 as the second pole of the sixth transistor T6, and the third testing control terminal 13 as the grid of the sixth transistor T6, thereby forming a circuit for testing the characteristics of T6.

The eighth transistor T8 can be tested in the same way. When the low levels of the third testing control terminal 13 and the fourth testing control terminal 14 turn on the second transistor T2 and the sixth transistor T6, the second testing control terminal 12 serves as the grid of the eighth transistor T8, the first testing control terminal 11 serves as the first pole of the eighth transistor T8, and the second testing output terminal 16 serves as the second pole of the eighth transistor T8 via the sixth transistor T6 and the second transistor T2.

The performance of T2/T6/T8 can be tested by lapping a probe on the corresponding testing terminal.

4. Testing the Fourth Transistor T4 and the Fifth Transistor T5

Figure 8:
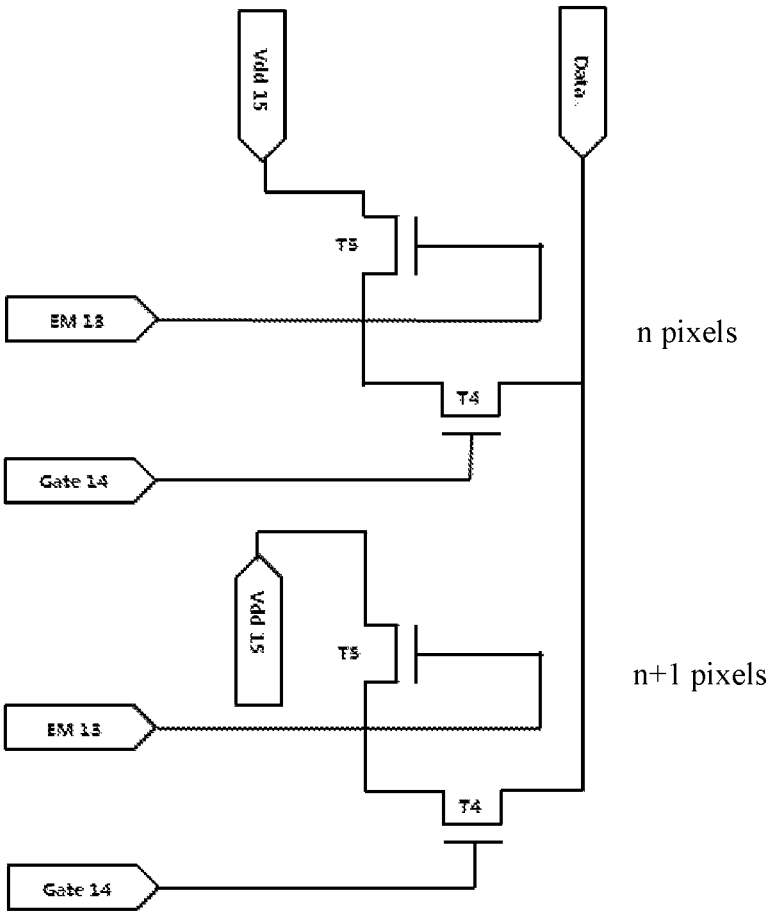
FIG. 8 is a fourth structural diagram of a testing circuit according to an embodiment of the disclosure.

When the fourth transistor T4 and the fifth transistor T5 need to be tested, part of the circuit is cut off, and the first transistor T1, the second transistor T2, the sixth transistor T6, the seventh transistor T7, the eighth transistor T8, the driving transistor DTFT and the storage capacitor Cst are disconnected from the circuit. In the embodiment of the disclosure, in order to reduce the coupling on a data line, no input/output testing terminal is designed on the data line. Therefore, in the embodiment of the disclosure, the data line is used as a connecting line between two adjacent pixel rows (exemplified by the n<th> row and the (n+1)<th> row), so that the transistors in the two adjacent pixel rows are combined to form a circuit structure of a testing circuit as shown in FIG. 8.

To test the fourth transistor T4 (*n*) in the n<th> row (first pixel row), a low-level signal is applied to the third testing control terminal 13 in the n<th> row, the third testing control terminal 13 in the (n+1)<th> row (second pixel row) and the fourth testing control terminal 14 in the (n+1)<th> row to turn on the fifth transistor T5 (*n*) in the n<th> row and the fourth transistor T4 (*n*+1) and the fifth transistor T5 (*n*+1) in the (n+1)<th> row. When testing the fourth transistor T4 (*n*) in the n<th> row, the first testing output terminal 15 in the (n+1)<th> row serves as the first pole of the fourth transistor T4 (*n*) in the n<th> row via the fifth transistor T5 (*n*+1) and the fourth transistor T4 (*n*+1) in the (n+1)<th> row, the first testing output terminal 15 in the n<th> row can serve as the second pole of the fourth transistor T4 (*n*) in the n<th> row via the fifth transistor T5 (*n*) in the n<th> row, and the fourth testing control terminal 14 in the n<th> row can serve as the grid of the fourth transistor T4 (*n*) in the n<th> row. The performance of T4 in the n<th> row can be tested by lapping a probe on the corresponding testing terminal.

To test the fifth transistor T5 in the n<th> row, a low-level signal is applied to the fourth testing control terminal 14 in the n<th> row and the third testing control terminal 13 and the fourth testing control terminal 14 in the (n+1)<th> row to turn on the fourth transistor T4 (*n*) in the n<th> row and the fifth transistor T5 (*n*+1) and the fourth transistor T4 (*n*+1) in the (n+1)<th> row. The first testing output terminal 15 in the (n+1)<th> row serves as the first pole of the fifth transistor T5 (*n*) in the n<th> row via the fifth transistor T5 (*n*+1) and the fourth transistor T4 (*n*+1) in the (n+1)<th> row and the fourth transistor T4(*n*) in the n<th> row, the first testing output terminal 15 in the n<th> row serves as the second pole of the fifth transistor T5(*n*) in the n<th> row, and the third testing control terminal 13 in the n<th> row serves as the grid of the fifth transistor T5(*n*) in the n<th> row, thus forming a testing circuit for the fifth transistor T5. In Table 1, the above testing circuits are summarized.

TABLE 1

| Testing TFT | Vg | Vs | Vd | Testing circuit |
|---|---|---|---|---|
| DTFT | 11 | Vdd 15 | 16 | Vdd→T5→DTFT→T6→16 |
| T5/T6 | EM 13 | Vdd 15 | 16 | VDD→T5→DTFT→T6→16 |
| T1/T7/T8 | Reset 12 | 11 | 16 | 11→T8→T1→T7 (n − 1) →16 (n − 1) |
| T2 | Gate 14 | 11 | 16 | 11→T8→T2→T6→16 |
| T6 | EM 13 | 11 | 16 | 11→T8→T2→T6→16 |
| T8 | Reset 12 | 11 | 16 | 11→T8→T2→T6→16 |
| T4 | Gate 14 | Vdd 15 | Vdd 15 | Vdd(n + 1)15→T5(n + 1)→T4(n + 1)→T4(n)→T5(n)→Vdd(n)15 |
| T5 | EM 13 | Vdd 15 | Vdd 15 | Vdd(n + 1)15→T5(n + 1)→T4(n + 1)→T4(n)→T5(n)→Vdd(n)15 |

In the prior art, organic and inorganic insulating layers on TFT substrates need to be removed by corrosion, grinding and other methods, or focused ion beam (FIB) boring and lapping are conducted, and then probes are lapped on the sources, drains and grids of the TFTs to test the TFTs. However, because the corrosion accuracy and mechanical grinding accuracy of composite film layers can hardly be controlled to the micron level, the success rate of testing is extremely low. In addition, during FIB lapping, because the platinum plating or lapping effect is hard to confirm, the testing results fluctuate greatly and the accuracy is insufficient.

According to the embodiment of the disclosure, a metal Pad of a TFT testing point is designed on the same layer as the uppermost metal anode layer of the TFT, and the metal Pad is isolated from the TFT or a new TFT isolator is added, so that special positions such as the storage capacitor and the data line are prevented from being coupled by the testing metal Pad, thus forming a TFT testing structure. By cutting off some metal lines, a testing circuit is formed in a test pixel or phase separation pixel, a voltage is applied to the testing metal Pad (Gate/EM/Reset/Vinit AND) to control the on-off of the pixel circuit, and signal change is input or detected at a test metal testing terminal (Vinit AND/Vdd/AND) to test the characteristics of each TFT in the pixel circuit. According to the testing method disclosed by the embodiment of the present disclosure, more convenient tests with high success rate and high accuracy can be realized.

The above only describes preferred embodiments of this application and applied technical principles. It should be understood by those skilled in the art that the scope of disclosure involved in this application is not limited to technical solutions formed by the specific combination of the above-mentioned technical features, but also covers other technical solutions formed by any combination of the above-mentioned technical features or their equivalent features without departing from the aforementioned disclosed concepts, for example, technical solutions formed by replacing the above features with technical features with similar functions disclosed in this application (but not limited thereto).

The invention claimed is:

1. A pixel circuit, comprising:

a light emitting element;

a drive sub-circuit configured to generate a current for causing the light emitting element to emit light;

a reset sub-circuit configured to receive a reset control signal from a reset control signal line and a reset signal from a reset signal line, and reset the drive sub-circuit and an anode of the light emitting element with the reset signal under the action of the reset control signal;

a write sub-circuit configured to receive a data signal from a data line and a scan signal from a scan signal line, and to supply the data signal to the drive sub-circuit under the action of the scan signal;

a light emission control sub-circuit configured to receive a first supply voltage from a first power line and a light emission control signal from a light emission signal line, and to supply the first supply voltage to the drive sub-circuit and the current generated by the drive sub-circuit to the anode of the light emitting element under the action of the light emission control signal; and a testing element, a control terminal of the testing element being connected to the reset control signal line, a first terminal of the testing element being connected to the reset signal line, a second terminal of the testing element being connected to the drive sub-circuit, and the testing element being configured to test elements included in the pixel circuit;

wherein the pixel circuit further comprises:

a plurality of testing terminals including testing control terminals and testing output terminals and configured in such a way that testing control signals are applied via the testing control terminals and testing output signals are acquired via the testing output terminals, so that the elements included in the pixel circuit are tested according to the testing output signals.

2. The circuit according to claim 1, wherein the testing control terminals include a first testing control terminal connected to the reset signal line, a second testing control terminal connected to the reset control signal line, a third testing control terminal connected to the light emission signal line and a fourth testing control terminal connected to the scanning signal line; and the testing output terminals include a first testing output terminal connected to the first power line and a second testing output terminal connected to the anode of the light emitting element.

3. The circuit according to claim 2, wherein the first testing control terminal to the fourth testing control terminal and the first testing output terminal and the second testing output terminal are all formed on an uppermost OLED anode layer of a substrate.

4. The circuit according to claim 1, wherein the plurality of testing terminals are disposed in the same layer as the anode of the light emitting element.

5. The circuit according to claim 1, wherein the drive sub-circuit comprises a driving transistor and a storage capacitor, a first pole of the storage capacitor is connected to the first power line, a second pole of the storage capacitor is connected to a grid of the driving transistor and the second terminal of the testing element, and a first pole and a second pole of the driving transistor are both connected to the light emission control sub-circuit.

6. The circuit according to claim 5, wherein the reset sub-circuit comprises a first transistor and a seventh transistor, a grid of the first transistor is connected to the reset control signal, a first pole of the first transistor is connected to the second terminal of the testing element, a second pole of the first transistor is connected to the reset signal line, a grid of the seventh transistor is connected to the scan signal line, a first pole of the seventh transistor is connected to the anode of the light emitting element, and a second pole of the seventh transistor is connected to the reset signal line.

7. The circuit according to claim 5, wherein the write sub-circuit comprises a second transistor and a fourth transistor, a grid of the second transistor and a grid of the fourth transistor are both connected to the scan signal line, a first pole of the second transistor is connected to the second pole of the driving transistor, a second pole of the second transistor is connected to the grid of the driving transistor; and a first pole of the fourth transistor is connected to the data line, and a second pole of the fourth transistor is connected to the first pole of the driving transistor.

8. The circuit according to claim 5, wherein the light emission control sub-circuit comprises a fifth transistor and a sixth transistor, a grid of the fifth transistor and a grid of the sixth transistor are both connected to the light emission signal line, a first pole of the fifth transistor is connected to the first power line, a second pole of the fifth transistor is connected to the first pole of the driving transistor, a first pole of the sixth transistor is connected to the second pole of the driving transistor; and a second pole of the sixth transistor is connected to the anode of the light emitting element, and a cathode of the light emitting element is connected to a second power line.

9. The circuit according to claim 5, wherein the first testing control terminals of a plurality of pixel circuits are connected by metal wires arranged on the uppermost OLED anode layer of the substrate.

10. The circuit according to claim 1, wherein the testing element comprises an eighth transistor, a grid of the eighth transistor serves as the control terminal of the testing element, and first and second poles of the eighth transistor serve as the first and second terminals of the testing element respectively.

11. A testing method of the pixel circuit according to claim 1, comprising: cutting off wiring at a designated position in the pixel circuit to obtain a testing circuit including at least one designated element of the pixel circuit; and testing the at least one designated element by the testing circuit.

12. The method according to claim 11, wherein testing the at least one designated element by the testing circuit comprises:

determining at least one testing control terminal and testing output terminal from the testing control terminals and the testing output terminals according to a designated element to be tested among the at least one designated element;

applying a testing control signal to the testing circuit via the determined at least one testing control terminal; and acquiring a testing output signal via the determined testing output terminal, and testing the designated element to be tested according to the testing output signal.

13. The method according to claim 12, wherein the testing circuit comprises a driving transistor, a fifth transistor, a sixth transistor and an eighth transistor, and testing the at least one designated element by the testing circuit comprises:

when testing the driving transistor, the first testing control terminal serves as the grid of the driving transistor, the first testing output terminal serves as the source of the driving transistor, and the second testing output terminal serves as the drain of the driving transistor;

when testing the fifth transistor, the third testing control terminal serves as the grid of the fifth transistor, the first testing output terminal serves as the first pole of the fifth transistor, and the second testing output terminal serves as the second pole of the fifth transistor; and when testing the sixth transistor, the third testing control terminal serves as the grid of the sixth transistor, the first testing output terminal serves as the first pole of the sixth transistor, and the second testing output terminal serves as the second pole of the sixth transistor.

14. The method according to claim 12, wherein the testing circuit comprises a first transistor, an eighth transistor, and a seventh transistor in the adjacent pixel row, and testing the at least one designated element by the testing circuit comprises:

when testing the first transistor or the eighth transistor, the second testing control terminal serves as the grids of the first transistor and the eighth transistor, the first testing control terminal serves as the first poles of the first transistor and the eighth transistor, and the second testing output terminal of the adjacent pixel row serves as the second poles of the first transistor and the eighth transistor; and when testing the seventh transistor in the adjacent pixel row, the fourth testing control terminal serves as the grid of the seventh transistor, the first testing control terminal serves as the first pole of the seventh transistor, and the second testing output terminal of the adjacent pixel row serves as the second pole of the seventh transistor.

15. The method according to claim 12, wherein the testing circuit comprises a second transistor, a sixth transistor and an eighth transistor, and testing the at least one designated element by the testing circuit comprises:

when testing the second transistor, the fourth testing control terminal serves as the grid of the second transistor, the second testing output terminal serves as the first pole of the second transistor, and the first testing control terminal serves as the second pole of the second transistor;

when testing the sixth transistor, the third testing control terminal serves as the grid of the sixth transistor, the first testing control terminal serves as the first pole of the sixth transistor, and the second testing output terminal serves as the second pole of the sixth transistor; and when testing the eighth transistor, the second testing control terminal serves as the grid of the eighth transistor, the first testing control terminal serves as the first pole of the eighth transistor, and the second testing output terminal serves as the second pole of the eighth transistor.

16. The method according to claim 12, wherein the testing circuit comprises fourth transistors respectively located in an adjacent first pixel row and second pixel row and fifth transistors respectively located in the first pixel row and the second pixel row, and testing the at least one designated element by the testing circuit comprises:

when testing the fourth transistor in the first pixel row, the fourth testing control terminal in the first pixel row serves as the grid of the fourth transistor, the first testing output terminal in the second pixel row serves as the first pole of the fourth transistor, and the first testing output terminal in the first pixel row serves as the second pole of the fourth transistor; and when testing the fifth transistor in the first pixel row, the third testing control terminal in the first pixel row serves as the grid of the fifth transistor, the first testing output terminal in the first pixel row serves as the first pole of the fifth transistor, and the first testing output terminal in the second pixel row serves as the second pole of the fifth transistor.

17. A display, comprising:

a light emitting element;

a drive sub-circuit configured to generate a current for causing the light emitting element to emit light;

a reset sub-circuit configured to receive a reset control signal from a reset control signal line and a reset signal from a reset signal line, and reset the drive sub-circuit and an anode of the light emitting element with the reset signal under the action of the reset control signal;

a write sub-circuit configured to receive a data signal from a data line and a scan signal from a scan signal line, and to supply the data signal to the drive sub-circuit under the action of the scan signal;

a light emission control sub-circuit configured to receive a first supply voltage from a first power line and a light emission control signal from a light emission signal line, and to supply the first supply voltage to the drive sub-circuit and the current generated by the drive sub-circuit to the anode of the light emitting element under the action of the light emission control signal; and a testing element, a control terminal of the testing element being connected to a testing control terminal, a first terminal of the testing element being connected to the reset signal line, a second terminal of the testing element being connected to the drive sub-circuit, and the testing element being configured to test elements included in the pixel circuit;

wherein the pixel circuit further comprises:

a plurality of testing terminals including testing control terminals and testing output terminals and configured in such a way that testing control signals are applied via the testing control terminals and testing output signals are acquired via the testing output terminals, so that the elements included in the pixel circuit are tested according to the testing output signals.

* * * * *